US009919435B1

(12) United States Patent
Enguita

(10) Patent No.: US 9,919,435 B1
(45) Date of Patent: Mar. 20, 2018

(54) UTILITY TOOL

(71) Applicant: Steven Enguita, Fort Myers, FL (US)

(72) Inventor: Steven Enguita, Fort Myers, FL (US)

( * ) Notice: Subject to any disclaimer, the term of this patent is extended or adjusted under 35 U.S.C. 154(b) by 0 days.

(21) Appl. No.: 15/479,267

(22) Filed: Apr. 4, 2017

(51) Int. Cl.

| | |
|---|---|
| ***B26B 11/00*** | (2006.01) |
| ***B26B 5/00*** | (2006.01) |
| ***B25F 1/00*** | (2006.01) |
| ***B25F 1/04*** | (2006.01) |
| ***E04F 21/00*** | (2006.01) |

(52) U.S. Cl.
CPC ..... *B26B 11/006* (2013.01); *B25F 1/006* (2013.01); *B25F 1/04* (2013.01); *B26B 5/006* (2013.01); *E04F 21/00* (2013.01); *B25F 1/00* (2013.01)

(58) Field of Classification Search
CPC ..... B26B 11/006; B26B 5/006; B25F 1/006; B25F 1/04; B25F 1/00; B25F 1/02; E04F 21/00; B44D 3/162; B44D 3/164; B44D 3/105
See application file for complete search history.

(56) References Cited

U.S. PATENT DOCUMENTS

| | | | | |
|---|---|---|---|---|
| 1,204,676 | A | 11/1916 | Machuga | |
| 1,264,430 | A | 4/1918 | Ossman | |
| 1,635,649 | A | 7/1927 | Tillmanns | |
| 2,213,071 | A * | 8/1940 | Keller | B44D 3/105 30/169 |
| 2,332,656 | A | 10/1943 | Mirando | |
| 2,980,996 | A | 4/1961 | Beran | |
| 3,316,634 | A * | 5/1967 | Bliss | A45D 29/02 30/143 |
| 4,187,607 | A * | 2/1980 | Simuro | B26B 11/001 168/48.1 |
| 4,607,407 | A | 8/1986 | Bergmeister | |
| 5,220,701 | A | 6/1993 | Creato | |
| 5,251,352 | A | 10/1993 | Cullison | |
| 5,272,782 | A | 12/1993 | Hutt | |
| 5,546,625 | A | 8/1996 | Mealey, Sr. | |
| 5,727,319 | A * | 3/1998 | Myerchin | B26B 11/008 30/123 |
| 5,870,786 | A | 2/1999 | Papadopoulos | |
| 6,257,106 | B1 * | 7/2001 | Anderson | B25F 1/003 7/129 |
| 6,427,274 | B1 | 8/2002 | Abbott | |
| 6,427,333 | B1 * | 8/2002 | Veltz | B26B 29/025 30/151 |
| 6,668,751 | B1 | 12/2003 | Henke | |
| 6,915,577 | B2 | 7/2005 | Scala | |
| 6,948,409 | B2 | 9/2005 | Ackeret et al. | |
| 7,305,770 | B2 | 12/2007 | Critelli et al. | |
| 7,437,822 | B2 | 10/2008 | Flagg et al. | |
| 7,480,997 | B2 * | 1/2009 | Ping | B26B 1/046 30/159 |
| 9,315,369 | B2 | 4/2016 | Wang | |
| 9,765,535 | B2 * | 9/2017 | Montgomery | E04F 21/32 |
| 2009/0025513 | A1 | 1/2009 | Salvino | |

* cited by examiner

*Primary Examiner* — Monica Carter
*Assistant Examiner* — Danny Hong

(57) ABSTRACT

A utility tool that combines several features, including a folding cutting blade, a putty knife or painter's multitool, and a finger loop that aids with manipulation of the utility tool.

15 Claims, 6 Drawing Sheets

UTILITY TOOL

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISC APPENDIX

Not applicable.

BACKGROUND

Putty knives and utility razor knives are popularly used in the painting and construction trades. Multi-function painter's tools may combine several single-purpose tools of these types into one device. Various approaches to such hand tools are the subject of, for example, U.S. Pat. Nos. 9,315,369; 7,437,822; 7,305,770; 6,948,409; 6,915,577; 6,668,751; 6,427,274; 5,870,786; 5,546,625; 5,272,782; 5,251,352; 5,220,701; 4,607,407; 2,980,996; 2,332,656; 1,635,649; 1,264,430; and 1,204,676; and U.S. Patent Application Publication No. 2009/0025513.

Tasks such as painting, scraping, patching, and cutting often require the use of one hand to hold a workpiece in place, and frequently are performed while standing on a ladder or otherwise in an awkward position. An ongoing need therefore exists for improved hand tools that provide enhanced utility and convenience.

SUMMARY

An object of the present invention is a utility tool that is configured to provide multiple tools useful to, for example, painters and builders, in a format that is easier to access and use with one hand.

An aspect of the present invention is directed to a utility tool comprising a handle defining a channel; a first blade holder rotatably attached to the handle; a first blade replaceably mounted within the first blade holder; a second blade fixedly attached to the handle; and a loop fixedly attached to the handle.

An additional aspect of the present invention is directed to a utility tool comprising the handle comprising two conjoined, substantially parallel grip panels, wherein the channel is formed between the grip panels.

An additional aspect of the present invention is directed to a utility tool comprising the handle comprising finger groove contours.

An additional aspect of the present invention is directed to a utility tool comprising the first blade holder configured to rotate between a first position at least partially disposed within the channel and a second position extended away from the channel and substantially collinear with the handle, further wherein the handle is configured to releasably immobilize the first blade holder in the second position.

An additional aspect of the present invention is directed to a utility tool wherein the first blade holder and the first blade comprise a utility knife.

An additional aspect of the present invention is directed to a utility tool wherein the second blade is substantially collinear with the handle.

An additional aspect of the present invention is directed to a utility tool wherein the second blade comprises a putty knife.

An additional aspect of the present invention is directed to a utility tool wherein the second blade comprises a painter's multitool.

An additional aspect of the present invention is directed to a utility tool wherein the second blade further comprises a bottle opener.

An additional aspect of the present invention is directed to a utility too wherein the second blade further comprises a nail puller hole.

An additional aspect of the present invention is directed to a utility tool wherein the second blade and the loop are integrated.

An additional aspect of the present invention is directed to a utility tool wherein the loop comprises a strike surface oriented substantially orthogonal to the longitudinal axis of the handle.

An additional aspect of the present invention is directed to a utility tool wherein the loop comprises a straight edge configured for use as a prying tool or as a screwdriver tip.

An additional aspect of the present invention is directed to a utility tool wherein the loop is sized to accommodate a digit of a user.

An additional aspect of the present invention is directed to a utility tool wherein the first blade holder and the loop are attached at or near a first end of the handle and the second blade is attached at or near a second end of the handle.

An additional aspect of the present invention is directed to a utility tool further comprising a belt clip fixedly attached to the handle.

The foregoing and other features and advantages of the invention will become further apparent from the following detailed description of the presently preferred embodiments, read in conjunction with the accompanying drawings. The detailed description and drawings are merely illustrative of the invention, rather than limiting the scope of the invention being defined by the appended claims and equivalents thereof.

BRIEF DESCRIPTION OF THE SEVERAL VIEWS OF THE DRAWING

Embodiments of the invention will be described below with reference to the following figures.

DETAILED DESCRIPTION

As used herein, the term "about" means approximately, in the region of, roughly, or around. When the term "about" is used in conjunction with a numerical value/range, it modifies that value/range by extending the boundaries above and below the numerical value(s) set forth. In general, the term "about" is used herein to modify a numerical value(s) above and below the stated value(s) within a confidence interval of 90% or 95%.

Figure 1:
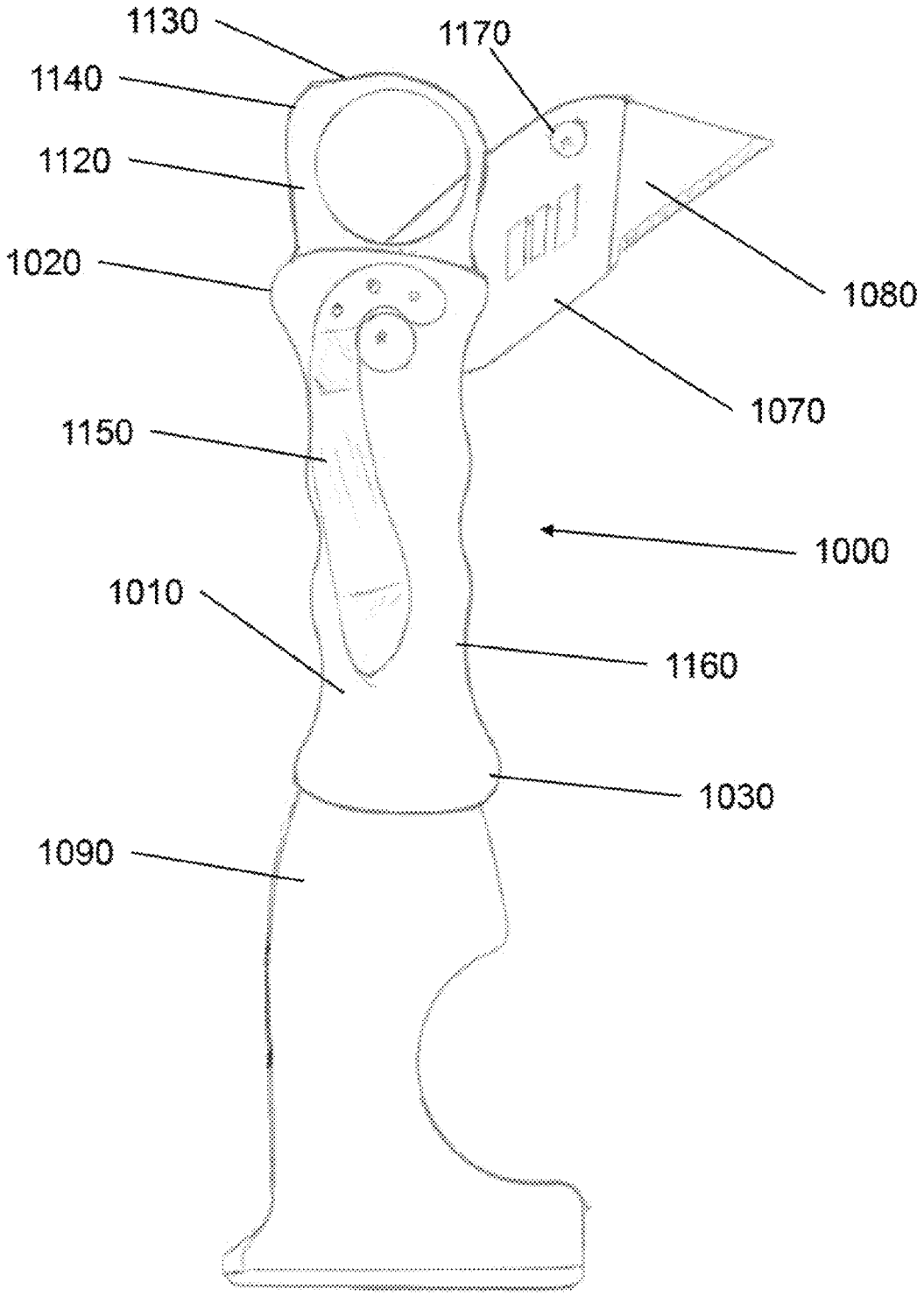
FIG. 1 shows a left side view of a utility tool of the present invention.
Figure 2:
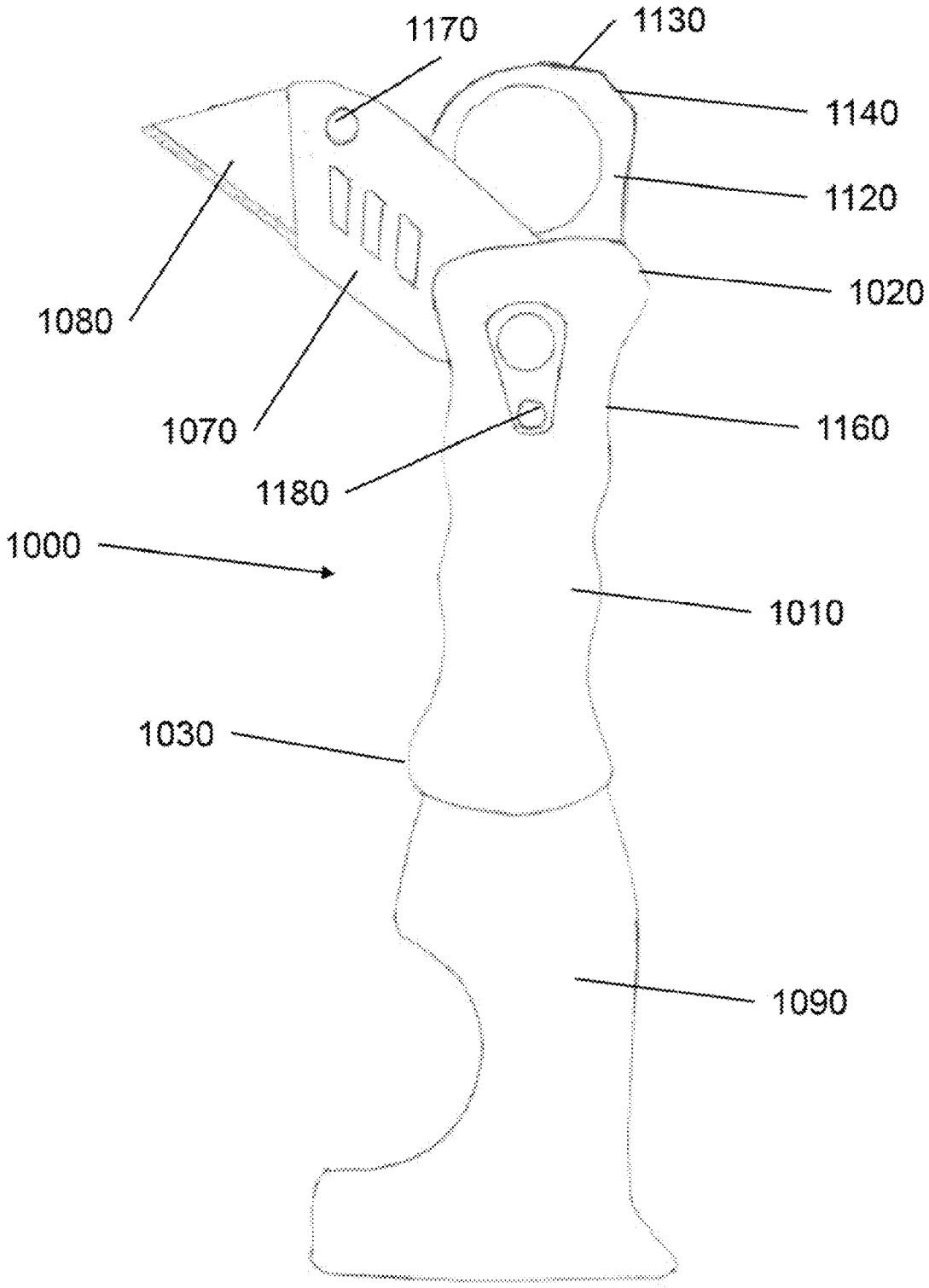
FIG. 2 shows a right side view of a utility tool of the present invention.
Figure 3:
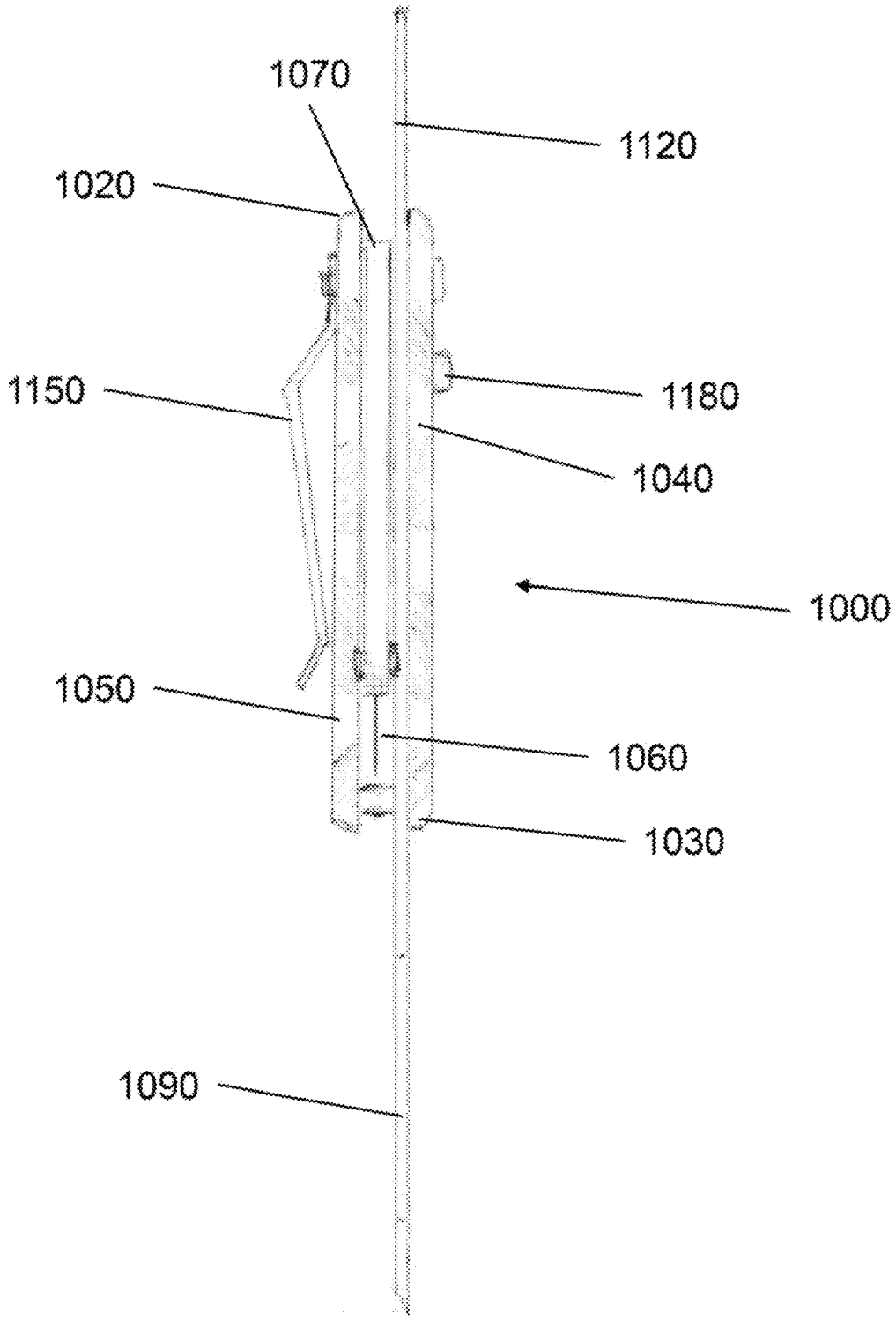
FIG. 3 shows a top view of a utility tool of the present invention.
Figure 4:
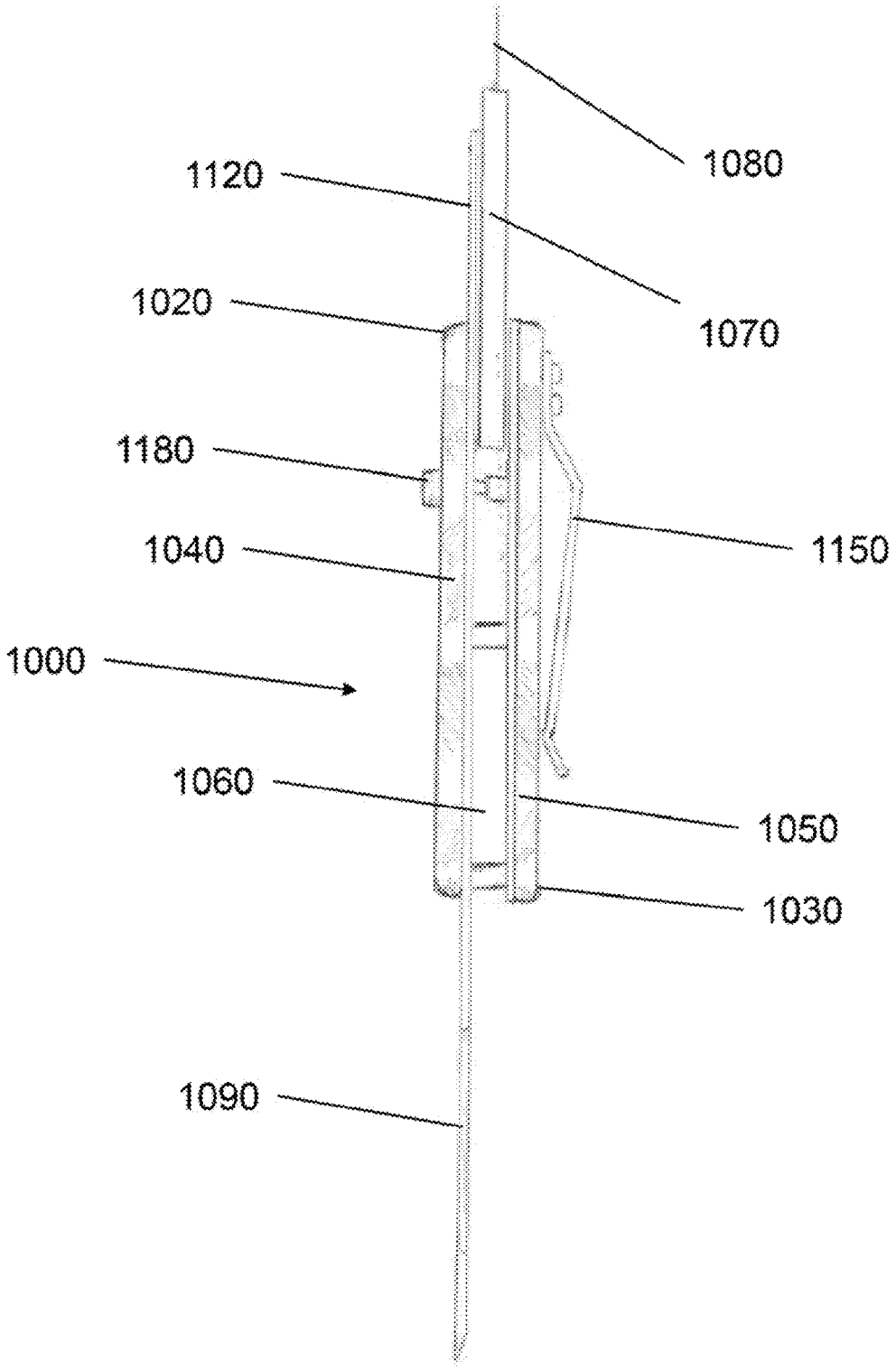
FIG. 4 shows a bottom view of a utility tool of the present invention.
Figure 5:
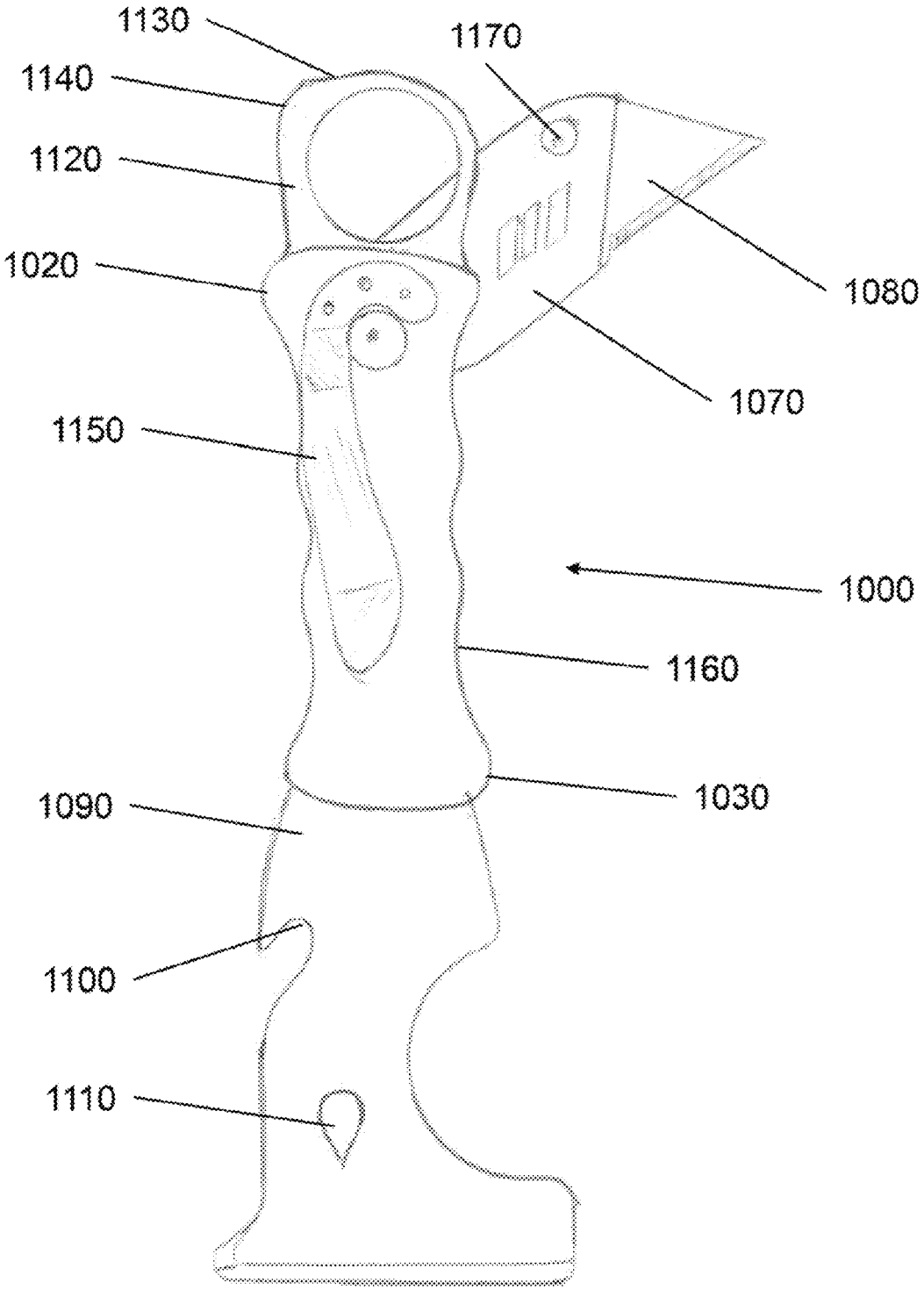
FIG. 5 shows a left side view of a utility tool of the present invention.
Figure 6:
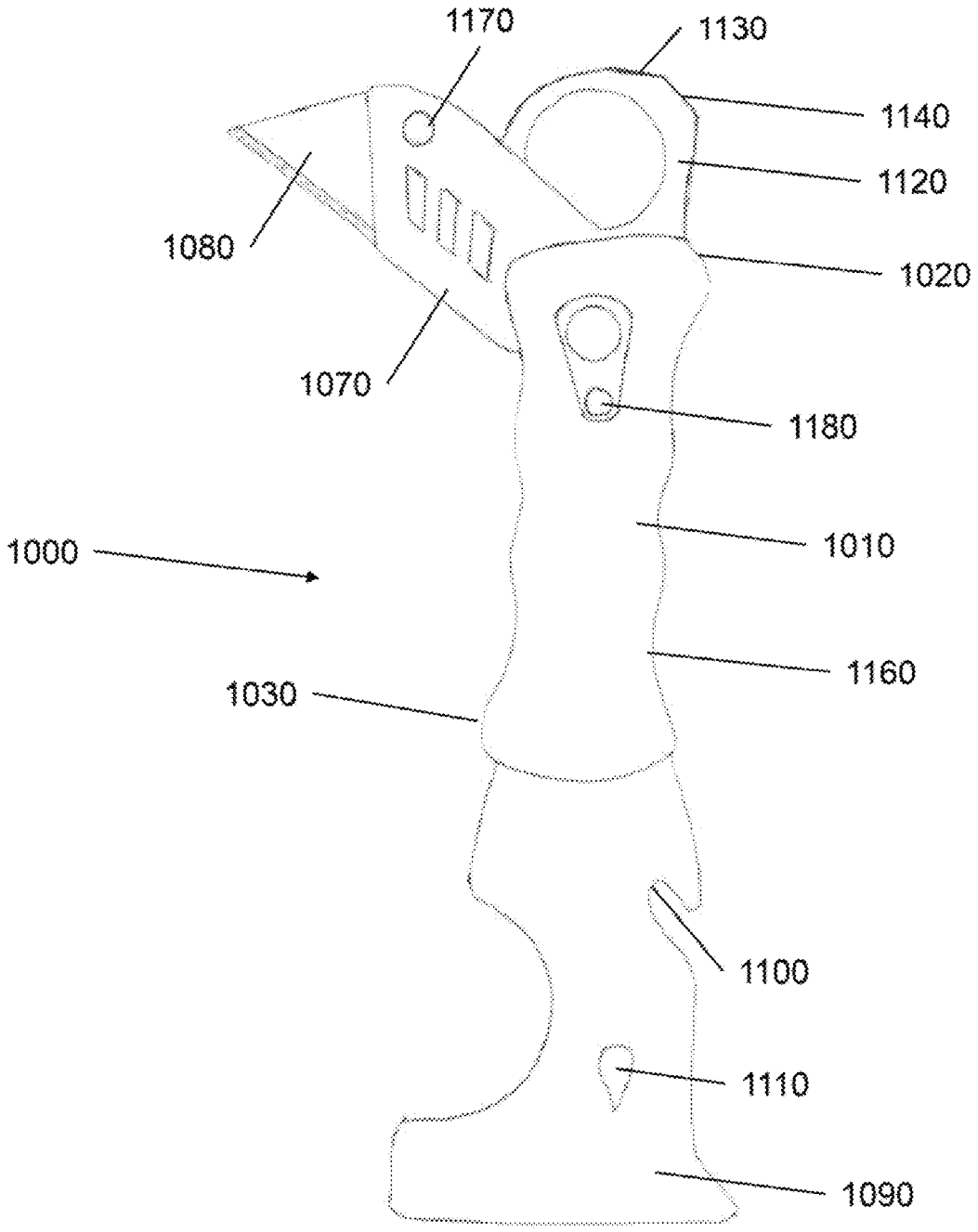
FIG. 6 shows a right side view of a utility tool of the present invention.

FIGS. 1, 2, 3, 4, 5 and 6 show various views of a utility tool 1000 of the present invention. The utility tool 1000 comprises an elongate handle 1010 having a first end 1020 and a second end 1030. The handle 1010 is sized suitably to accommodate a range of handgrip sizes for a variety of users. In some embodiments, the handle 1010 is sized from about three to about five inches long, from about 0.5 to about 1.25 inches wide, and from about 0.75 to about 1.25 inches thick.

In some embodiments, the handle 1010 compnses first 1040 and second 1050 grip panels that are attached to each other and spaced apart, defining a channel 1060 between the first 1040 and second 1050 grip panels. The handle 1010 and first 1040 and second 1050 grip panels may be constructed of plastic, metal (such as stainless steel or aluminum), fiberglass, carbon fiber, phenolic resin, or any other material having desired rigidity, durability and tactile properties. In some embodiments, the first 1040 and second 1050 grip panels are configured with contours that form finger grooves 1160 along one or both edges of the handle 1010, for the purpose of enhancing a users grip on the handle 1010.

In some embodiments, the utility tool 1000 further comprises a first blade holder 1070 and a first blade 1080 that is mounted therein, which is suitable for cutting tasks. In some embodiments, the first blade 1080 is mounted so as to protrude from only one end of the first blade holder 1070.

In some embodiments, the first blade holder 1070 and the first blade 1080 together comprise a utility knife. The first blade 1080 may be a commercially-available, single-edged razor blade, and the first blade holder 1070 may be configured with a locking mechanism that allows selectable unmounting of the first blade 1080 so that the first blade 1080 is replaceable. In some embodiments, the locking mechanism is activated by depressing a button 1170 located on the first blade holder 1070.

In some embodiments, the end of the first blade holder 1070 from which the first blade 1080 does not protrude is mounted between the first 1040 and second 1050 grip panels at or near the first end 1020 of the handle 1010 in a manner that enables the first blade holder 1070 to rotate about the axis of attachment between the first blade holder 1070 and the first 1040 and second 1050 grip panels. In a closed position, the first blade holder 1070 is disposed at least partially within the channel 1060 in the handle 1010, such that the single cutting edge of the first blade 1080 is positioned within the channel 1060, thereby shielding a user from exposure to the cutting edge. The first blade holder 1070 is moved to an open position by rotating through an arc away from the channel 1060, and, in the open position, extends substantially collinear with the handle 1010.

In some embodiments, the handle 1010 is configured with a locking mechanism that enables a user to lock the first blade holder 1070 in the open position and selectably unlock and release the first blade holder 1070 from the open position so that the first blade holder 1070 may be returned to the closed position. According to the present invention, locking the first blade holder 1070 in the open position facilitates use of the first blade 1080 for cutting tasks, while placing the first blade holder 1070 in the closed position allows safe storage of the utility tool 1000. In some embodiments, the locking mechanism is activated by depressing a button 1180 located on the handle 1010.

In some embodiments, the utility tool 1000 further comprises a second blade 1090 that is attached to the handle 1010 in a fixed position at or near the second end 1030 of the handle 1010 and substantially collinear with the handle 1010. The second blade 1090 may be constructed of metal, plastic or any other suitably rigid and durable material, In some embodiments, the second blade 1090 is a putty knife, or alternatively, a paint multitool, such as a 5-in-1 painter's tool that may be used to scrape paint, spread compound, remove putty, open cracks and clean rollers. In some embodiments, the second blade 1090 comprises additional tools such as a bottle opener 1100 or nail puller hole 1110.

In some embodiments, the utility tool 1000 further comprises a loop 1120 attached to the handle 1010 in a fixed position at or near the first end 1020 of the handle 1010 and substantially collinear with the handle 1010. In some embodiments, the loop 1120 is constructed of metal, plastic or any other suitably rigid and durable material that defines a loop 1120 opening sized to accommodate a finger or thumb of a user. In some embodiments, the loop 1120 opening diameter is from about 0.5 to about 1.25 inches.

According to the present invention, a user may insert a finger or thumb through the loop 1120 in order to grasp and deploy the utility tool 1000 from a pocket or belt more conveniently and using only one hand. The loop 1120 provides an index point that is easily found only by touch. The loop 1120 additionally provides a means for the user to spin the utility tool 1000 around the finger or thumb in order to change the position and orientation of the utility tool 1000 in the user's hand more quickly and easily, and, for example, bring the second blade 1090 or putty knife into a suitable position for use. The capability provided by the loop 1120 is especially crucial when the user is forced to maintain visual contact with a workpiece and hold the workpiece in place using one hand, while deploying and using the utility tool 1000 on the workpiece with the other hand.

In some embodiments, the loop 1120 is substantially parallel to, and spatially offset from, the first blade holder 1070 disposed in the open position, such that the loop 1120 does not intersect the plane of rotation of the first blade holder 1070 and the first blade 1080 between the closed position and the open position. According to the present invention, the attachment of the loop 1120 adjacent to the first blade holder 1070 at or near the first end 1020 of the handle 1010 provides an additional safety feature. The first blade holder 1070 deployed in the open position blocks a user from inserting a finger or thumb through the loop 1120, so that the user is prevented from, for example, spinning the utility tool 1000 around the finger or thumb while the first blade holder 1070 is locked in the open position, which otherwise would expose the user to risk of being cut by the first blade 1080.

In some embodiments, one piece of material defines the loop 1120 and the second blade 1090 as an integrated member, extending continuously between the first 1040 and second 1050 grip panels and protruding from the first 1020 and second 1030 ends of the handle 1010. According to the present invention, providing an integrated member defining the loop 1120 and the second blade 1090 enhances the longitudinal strength and rigidity of the utility tool 1000 when, for example, the second blade 1090 is used for scraping tasks or the loop 1120 is used for striking or hammering tasks.

In some embodiments, the loop 1120 comprises additional tools, such as a flat strike surface 1130 substantially perpendicular to the longitudinal axis of the handle 1010, which enables use of the utility tool 1000 as a hammer when the strike surface 1130 impacts a workpiece, or a straight, thin edge 1140 that may be used as a prying tool or screwdriver tip.

In some embodiments, a belt clip 1050 is attached to the handle 1010, facilitating convenient carry of the utility tool 1000 by a user on a belt or in a pocket.

Example embodiments have been described herein for illustrative purposes only and are not limiting. Other embodiments are possible and are covered by the disclosure and the teachings contained herein. The breadth and scope of the disclosure should not be limited by any of the above-described embodiments, but should be defined only in accordance with features and claims supported by the present disclosure and their equivalents. Moreover, embodiments of the subject disclosure may include formulations, compounds, methods, systems, and devices which may further include any and all elements/features from any other disclosed formulations, compounds, methods, systems, and devices, including the manufacture and use thereof. Features from one and/or another disclosed embodiment may be interchangeable with features from other disclosed embodiments, which, in turn, correspond to yet other embodiments. One or more features/elements of disclosed embodiments may be removed and still result in patentable subject matter (and thus, resulting in yet more embodiments of the subject disclosure). Furthermore, some embodiments of the present disclosure may be distinguishable from the prior art by specifically lacking one and/or another feature, functionality, ingredient or structure, which is included in the prior art (i.e., claims directed to such embodiments may include "negative limitations" or "negative provisos").

All references, articles, publications, patents, patent publications, and patent applications cited herein are incorporated by reference in their entireties for all purposes. Mention of any reference, article, publication, patent, patent publication, and patent application cited herein is not an acknowledgment that they constitute valid prior art or form part of the common general knowledge in any country in the world.

What is claimed is:

1. A utility tool comprising:

a) a handle defining a channel;

b) a first blade holder rotatably attached to the handle;

c) a first blade replaceably mounted within the first blade holder;

d) a second blade fixedly attached to the handle; and e) a loop fixedly attached to the handle, wherein the first blade holder and the loop are attached at or near a first end of the handle and the second blade is attached at or near a second end of the handle.

2. The utility tool of claim 1, wherein the handle comprises two conjoined, substantially parallel grip panels, wherein the channel is formed between the grip panels.

3. The utility tool of claim 1, wherein the handle comprises finger groove contours.

4. The utility tool of claim 1, wherein the first blade holder is configured to rotate between a first position at least partially disposed within the channel and a second position extended away from the channel and substantially collinear with the handle, further wherein the handle is configured to releasably immobilize the first blade holder in the second position.

5. The utility tool of claim 1, wherein the first blade holder and the first blade comprise a utility knife.

6. The utility tool of claim 1, wherein the second blade is substantially collinear with the handle.

7. The utility tool of claim 1, wherein the second blade comprises a putty knife.

8. The utility tool of claim 1, wherein the second blade comprises a painter's multitool.

9. The utility tool of claim 8, wherein the second blade further comprises a bottle opener.

10. The utility tool of claim 8, wherein the second blade further comprises a nail puller hole.

11. The utility tool of claim 1, wherein the second blade and the loop are integrated.

12. The utility tool of claim 1, wherein the loop comprises a strike surface oriented substantially orthogonal to the longitudinal axis of the handle.

13. The utility tool of claim 1, wherein the loop comprises a straight edge configured for use as a prying tool or as a screwdriver tip.

14. The utility tool of claim 1, wherein the loop is sized to accommodate a digit of a user.

15. The utility tool of claim 1, further comprising a belt clip fixedly attached to the handle.

* * * * *